United States Patent [19]

Bond et al.

[11] Patent Number: 4,589,709

[45] Date of Patent: May 20, 1986

[54] LOCKING COVER FOR AIR CONDITIONER

[75] Inventors: Ralph W. Bond, Cedar Rapids; Harold W. Pitz, Amana, both of Iowa

[73] Assignee: Amana Refrigeration, Inc., Amana, Iowa

[21] Appl. No.: 661,637

[22] Filed: Oct. 17, 1984

[51] Int. Cl.[4] ..... A47B 43/00

[52] U.S. Cl. ..... 312/257 A; 49/465; 109/68

[58] Field of Search ..... 312/257 A, 292, 291; 49/465, 460; 109/68, 78, 81, 49.5

[56] References Cited

U.S. PATENT DOCUMENTS

| | | | |
|---|---|---|---|
| 1,921,051 | 8/1933 | Traut | 49/465 |
| 2,442,754 | 6/1948 | Beam | 248/634 X |
| 3,121,383 | 2/1964 | Parrish | 49/465 |
| 3,123,170 | 3/1964 | Bryant | 248/634 X |
| 3,481,288 | 12/1969 | Teleky | 109/68 |
| 3,537,212 | 11/1970 | Gilles | 49/465 |
| 4,145,978 | 3/1979 | Johnson et al. | 109/59 R |

*Primary Examiner*—James T. McCall

*Attorney, Agent, or Firm*—William R. Clark; Richard M. Sharkansky

[57] ABSTRACT

A locking cover for preventing unauthorized access to the control panel of an air conditioner. The locking cover is adapted for use with an air conditioner having a control panel seated between a frame connected to the control panel access opening and a spongy pad. The locking cover defines a plate having a side wall to elevate the plate above the knobs of the control panel. The wall has an outwardly extending flange which is adapted for removably inserting between the panel and the frame wherein the gap for the insertion is provided by pressing the panel to compress the spongy pad. A key lock mounted adjacent to the opposite edge of the plate is rotated so that a latching member moves to a locking position between the panel and the opposite side of the frame.

10 Claims, 4 Drawing Figures

LOCKING COVER FOR AIR CONDITIONER

BACKGROUND OF THE INVENTION

There are many types of room air conditioners. For example, some air conditioners provide cooling and they typically also have the capability for venting by recirculating room air or also introducing fresh air from the outside. Other air conditioners provide heating such as by a fan blowing air past electric coils or past a heat exchanger such as supplied by forced hot water from a remote source. Other air conditioners have the capability of providing a plurality of operational modes such as heating, cooling, and venting in one unit. Further, air conditioners are manufactured for a variety of installation categories such as free standing, wall mounted or window mounted. Regardless of the type or category of room air conditioner, however, one characteristic that is common to most is that each generally has a control panel which is used to set the operational parameters such as mode, fan speed, temperature, or vent.

In many applications, it is desirable to prevent unauthorized access to the control panel. For example, in schools, motels, and offices of business and Government, it may be desirable that the temperature and other operational parameters of an air conditioner be set by a building custodian as part of an energy efficiency plan. In such case, it may be necessary to limit access to the control panel so as to prevent unauthorized people from changing the preset operational parameters.

Many room air conditioners have an opening in the air conditioner enclosure and the control panel is recessed below the opening. Frequently, a hinged door or lid is provided to improve the appearance of the unit; the lid may also serve to ease cleaning and prevent inadvertent bumping of the control knobs. The standard prior art approach to preventing unauthorized access to the control panel is to put a lock on the lid. Conventionally, an aperture is cut in the lid and a key lock with a rotating latch member is mounted. Only those having the key can unlatch the latching member to open the lid and gain access to the control knobs. This approach, however, has disadvantages. First, to retrofit air conditioners already in the field, the aperture in the door must be drilled for mounting the lock; this normally requires proper tools and a trained technician. Also, a groove for receiving the latch member may have to be provided. Second, if the lock is to be added to the door during manufacturing, different models have to be provided and inventoried because many applications do not require a locked door and many consumers wouldn't want it.

SUMMARY OF THE INVENTION

An object of the invention is to provide apparatus and method for preventing unauthorized access to the control panel of an air conditioner. It is another object to provide apparatus and method that can readily be used to secure air conditioners in the field without retrofit. Further, it is an object to provide a locking cover that can be added to an air conditioner without modification to the air conditioner unit.

These and other objects are provided in accordance with the invention which defines a removable locking cover for an air conditioner control panel seated between a resilient pad and a peripheral region of the control panel access opening in the air conditioner enclosure, comprising a cover plate having a flange adapted for removably inserting between the panel and one side of the peripheral region and a lock connected to the plate, the lock having a rotatable latching member adapted for rotating to a locked position between the panel and the opposite side of the peripheral region wherein, in the locked position, access to the control panel is prevented. The invention may further comprise a wall between the plate and the flange for spacing the plate from the panel.

The invention may also define a removable locking cover for an air conditioner control panel positioned behind an access opening in the enclosure of the air conditioner and engaged between the peripheral region of the enclosure around the opening and a resilient pad, comprising a cover plate, means for spacing the plate from the panel, means connected to the spacing means removably insertable between the panel and the peripheral region on one side of the opening for securing the cover plate on one side, and a lock connected to the cover plate, the lock having a rotatable arm adapted for inserting between the panel and the peripheral region on the opposite side of the opening for securing the cover plate on the opposite side. It may be preferable that the spacing means defines a downwardly bent wall from the control plate and that the flange defines a lip bent outwardly from the bottom of the wall. Accordingly, the locking cover can be formed by one sheet of metal. It may be preferable that the lock is a key lock such as could be mounted to the cover plate by drilling an aperture therein and mounting the key lock with a nut. One advantage of the invention is that the locking cover can be added to an unmodified air conditioner as described merely by pressing down on the control panel to compress the resilient pad, inserting the flange on one side between the panel and the peripheral region, and then rotating the locking member between the panel and the peripheral region on the opposite side to secure the cover plate over the control knobs of the control panel.

The invention may also be practiced by a removable locking cover for preventing unauthorized access to an air conditioner control panel housed in the air conditioner enclosure behind an access opening, the panel being engaged between a rectangular border frame connected in the opening and a compressible sponge layer behind the control panel, comprising a rectangular cover plate having one edge bent downwardly forming a wall for spacing the cover plate from the control panel, the wall having an outwardly extending flange adapted for removably inserting between the panel and one side of the frame, and a lock mounted on the cover plate adjacent to the opposite side of the wall, the lock having a rotatable arm adapted for inserting between the panel and the opposite side of the frame to lock the locking cover over the control panel thereby preventing access to the control panel until the lock is unlocked and the cover plate is removed.

The invention also defines an air conditioner comprising a control panel having a hole, an operator control having a shaft extending through the hole, the shaft having a control knob connected to its end, an enclosure having an opening for accessing the control panel, the opening having a perimeter frame engaging one surface of the control panel, a spongy pad positioned between the control panel and the control for seating the control panel snugly against the perimeter frame, a removable locking cover for preventing unauthorized access to the control panel through the access opening, the cover comprising a plate having a wall for spacing the plate above the control knob, the wall having an outwardly extending flange adapted for inserting between the panel and one side of the frame, and the locking cover having a lock connected to the plate, the lock having a rotatable latching member adapted for rotation to a locking position between the panel and the opposing side of the frame to secure the locking cover in place over the control panel whereby unauthorized access to the control knob through the access opening is prevented. The invention may further comprise a hinged door for the access opening. In other words, the locking cover is a unit which can be added to an existing air conditioner and is not a modification to the existing control panel lid.

The invention may further be practiced by the method of preventing unauthorized access to an air conditioner control panel engaged between a compressible spongy pad and a substantially rectangular frame bordering the enclosure access opening for the control panel, comprising the steps of: creating a first gap between the panel and one side of the frame by pressing the panel to compress the spongy pad, inserting a flange of a locking cover into the first gap, the locking cover comprising a cover plate having a side wall to space the plate from the panel, the flange extending outwardly from the side wall, creating a second gap between the panel and the opposite side of the frame by pressing the panel to compress the spongy pad, and rotating a latching arm of a key lock mounted to the cover plate into the second gap to secure the locking cover over the control panel.

BRIEF DESCRIPTION OF THE DRAWINGS

The foregoing objects and advantages of the invention will be more fully understood by reading the Description of the Preferred Embodiment with reference to the drawings wherein.

DESCRIPTION OF THE PREFERRED EMBODIMENT

Figure 1:
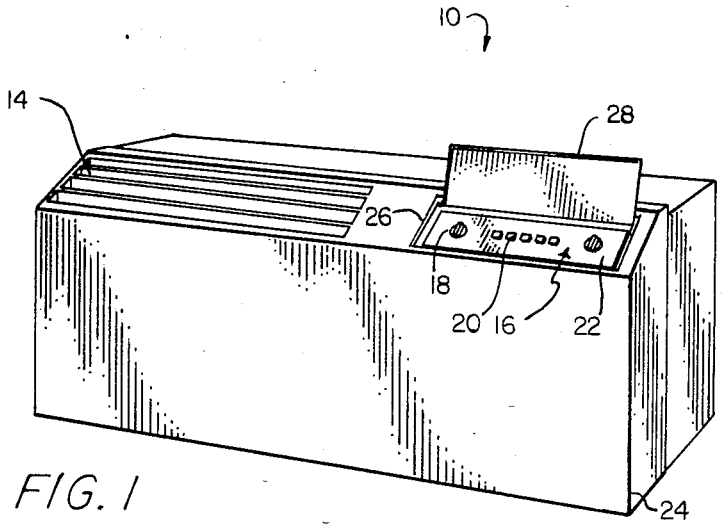
FIG. 1 is a perspective view of an air conditioner.

Referring to FIG. 1, there is shown a room air conditioner 10 with which the invention can be used to advantage. In one mode of operation, air conditioner 10 functions to cool the room by drawing in air from the room, extracting heat from it, and then recirculating it back into the room through discharge air grill 14; typically, fresh air can be added to the recirculating air by opening a fresh air vent (not shown). In another mode of operation, air conditioner 10 functions as a heater directing heated air into the room through discharge air grill 14. In still another mode, air conditioner 10 operates for venting by either recirculating room air or introducing fresh air from outside. Although air conditioner 10 has been described as a unit that can be operated in a plurality of operational modes such as cooling, heating, and venting, the invention has application to climate control units having only one operating mode. In fact, it will be apparent that the invention can be used to advantage with any suitable operator control panel to which access is to be restricted.

As is conventional, the operator controls for the above-described operational modes or other modes are provided on control panel 16. More specifically, control panel 16 typically includes control knobs such as, for example, rotary knobs 18 or push button knobs 20 and the escutcheon 22 or panel itself which provides labels to identify the functions of the control knobs. For example, a rotary knob 18 may open and close a fresh air vent and a push button knob may determine the operational mode and fan speed. The room side of air conditioner 10 is encased in enclosure 24 or casing. Enclosure 24 has an opening 26 which is typically rectangular and a hinged door 28 or lid that can be opened to provide access to control panel 16. The apparatus described heretofore is conventional.

Figure 2:
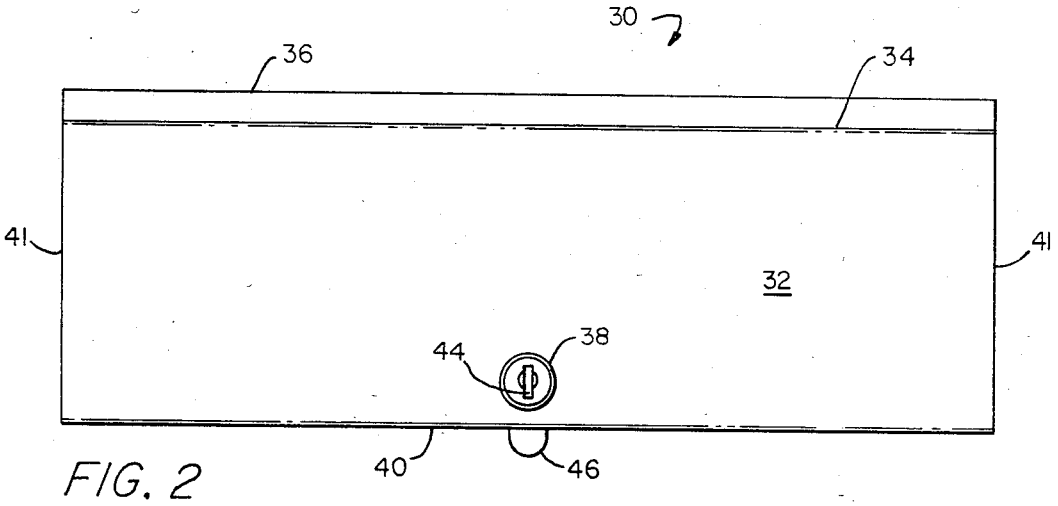
FIG. 2 is a top view of the locking cover.
Figure 3:
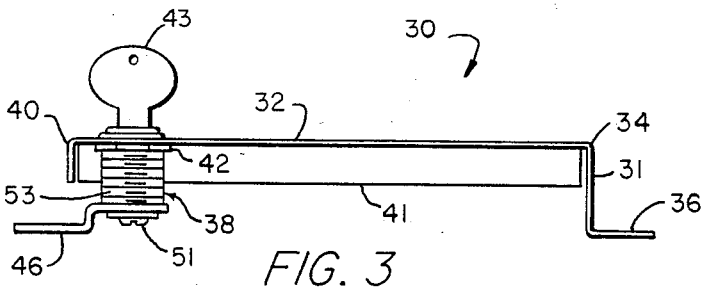
FIG. 3 is a side view of the locking cover.

Referring to FIGS. 2 and 3, there are shown top and side views of locking cover 30 in accordance with the invention. Locking cover 30 has a cover plate 32 which has an edge 34 which is bent downwardly to form spacing wall 31 and then outwardly to form a tongue or flange 36. The size and shape of cover plate 32 generally conforms to opening 26 so that locking cover 30 may be inserted into opening 26 and installed over control knobs 18 and 20 as will be described later herein. A conventional key lock 38 is mounted by suitable means adjacent to the opposite edge 40 of cover plate 32. For example, cover plate 32 may have an aperture through which key lock 38 inserts. Key lock 38 may then be rigidly secured to cover plate 32 by nut 42. A key 43 may be inserted into key hole 44 to rotate arm 46 or latching member. Edge 40 and ends 41 are bent downwardly to provide structural rigidity and to prevent articles from being inserted under locking cover 30 when secured over control panel 16.

Figure 4:
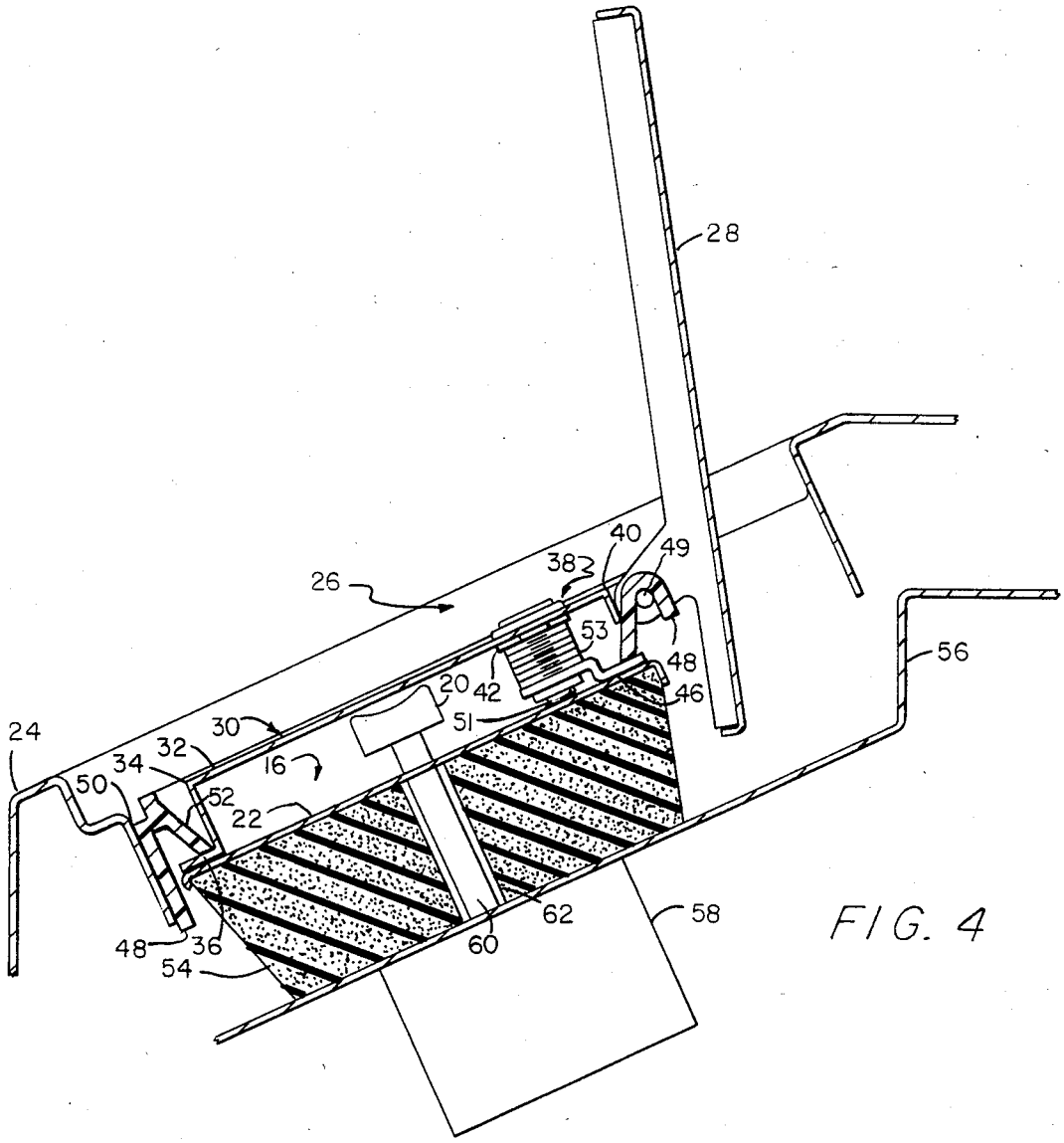
FIG 4 is a sectioned side view of the locking cover secured in place over the control panel of the air conditioner.

Referring to FIG. 4, a side sectioned view of control panel 16 is shown with locking cover 30 secured in place to prevent unauthorized access to control knobs 18 and 20. More specifically, enclosure 24 has a rectangular opening 26 for providing access to control panel 16. As is conventional, a plastic perimeter frame or bezel 48 is connected within the throat 50 of opening 26 by suitable means such as screws (not shown) and may include a hinge 49 to mount door 28. When locking cover 30 is not mounted in the position as shown in FIG. 4, the inward leg 52 of bezel 48 seats against the escutcheon 22 to secure it in place. The escutcheon 22 on which labels are embossed so as to identify the control knobs 18 and 20, sits on a resilient or spongy pad 54 which spaces the escutcheon from the control mounting plate 56. More specifically, the controls 58 are mounted on the control mounting plate 56 which is connected to the chassis of the air conditioner 10. Each control 58 has a shaft 60 or bar which extends up through a bore 62 in spongy pad 54. Because the spongy pad is resilient, the escutcheon 22 is seated snugly between it and the inward leg 52 of bezel 48 thereby preventing vibration. As an example, spongy pad 54 may be made of foam rubber.

Still referring to FIG. 4 and in accordance with the invention, unauthorized access to control panel 16 is prevented by inserting locking cover 30 over control panel 16 and, more particularly, control knobs 18 and 20. Specifically, after compressing spongy pad 54, flange 36 of locking cover 30 is inserted between escutcheon 22 and inward leg 52 of bezel 48. Next, edge 40 of cover plate 32 is pressed downwardly so that the bottom 51 of the cylinder 53 of key lock 38 compresses spongy pad 54 under the contacted portion of the escutcheon 22 to provide a space between escutcheon 22 and the adjacent inward leg 52 so that locking arm 46 can be rotated with the use of key 43 to the locking position as shown in FIG. 4. After the key is removed, the locking cover 30 is secured in place preventing unauthorized access to control knobs 18 and 20. As is apparent, future access to control panel 16 is accomplished by using the key and reversing the procedure to rotate locking arm 46 to a non-latching position whereby the locking cover 30 can be removed.

The locking cover has significant advantage in that it can be used to secure control panels of air conditioners in the field without modification or retrofit of the air conditioners. More particularly, door 28 is not altered so as to provide locking. Further, because a locking cover is an addition rather than a modification, there is no requirement to manufacture two different types of doors 28 so as to satisfy consumers who want a locking capability and those who don't.

This completes the description of the Preferred Embodiment. A reading of it by those skilled in the art will bring to mind many modifications and alterations without departing from the spirit and scope of the invention. Accordingly, it is intended that the scope of the invention be limited only by the appended claims.

What is claimed is:

1. A removable locking cover for an air conditioner control panel positioned behind an access opening in the enclosure of the air conditioner and engaged between the peripheral region of the enclosure around the opening and a resilient pad, comprising:

a cover plate;

means for spacing said plate from said panel;

means connected to said spacing means removably insertable between said panel and said peripheral region on one side of said opening for securing said cover plate on said one side; and a lock connected to said cover plate, said lock having a rotatable arm adapted for inserting between said panel and said peripheral region on the opposite side of said opening for securing said cover plate on said opposite side.

2. The locking cover recited in claim 1 wherein said spacing means defines a downwardly bent wall from said cover plate.

3. The locking cover recited in claim 2 wherein said flange defines a lip bent outwardly from the bottom of said wall.

4. The locking cover recited in claim 1 wherein said lock is a key lock.

5. A removable locking cover for preventing unauthorized access to an air conditioner control panel housed in the air conditioner enclosure behind an access opening, said panel being engaged between a rectangular border frame connected in said opening and a compressible sponge pad, comprising:

a rectangular cover plate having one edge bent downwardly forming a wall for spacing said cover plate from said control panel;

said wall having an outwardly extending flange adapted for removably inserting between said panel and one side of said frame; and a lock mounted on said cover plate adjacent to the opposite side of said wall, said lock having a rotatable arm adapted for inserting between said panel and the opposite side of said frame to lock said locking cover over said control panel thereby preventing access to said control panel until said lock is unlocked and said cover plate is removed.

6. The locking cover recited in claim 5 wherein said lock is a key lock.

7. An air conditioner comprising:

a control panel having a hole;

an operator control having a shaft extending through said hole, said shaft having a control knob connected to its end;

an enclosure having an opening for accessing said control panel;

said opening having a perimeter frame engaging one surface of said control panel;

a spongy pad positioned between said control panel and said control;

a removable locking cover for preventing unauthorized access to said control panel through said access opening, said cover comprising a plate having a side wall for spacing said plate above said control knob;

said wall having an outwardly extending flange adapted for inserting between said panel and one side of said frame; and said locking cover having a lock connected to said plate, said lock having a rotatable latching member adapted for rotation to a locking position between said panel and the opposite side of said frame to secure said locking cover in place over said control panel whereby unauthorized access to said control knob through said access opening is prevented.

8. The air conditioner recited in claim 7 further comprising a hinged door for said access opening.

9. The air conditioner recited in claim 7 wherein the spongy pad is resiliently compressible for forming a gap between said panel and said frame for inserting said flange and said latching member.

10. The method of preventing unauthorized access to an air conditioner control panel engaged between a compressible spongy pad and a substantially rectangular frame bordering the enclosure access opening for the control panel, comprising the steps of:

creating a first gap between said panel and one side of said frame by pressing said panel to compress said spongy pad;

inserting a flange of a locking cover into said first gap, said locking cover comprising a cover plate having a side wall to space said plate from said panel, said flange extending outwardly from said side wall;

creating a second gap between said panel and the opposite side of said frame by pressing said panel to compress said spongy pad; and rotating a latching arm of a key lock mounted to said cover plate into said second gap to secure said locking cover over said control panel.

* * * * *